US005268531A

United States Patent [19]

Nguyen et al.

[11] Patent Number: 5,268,531

[45] Date of Patent: Dec. 7, 1993

[54] FLAT CABLE

[75] Inventors: Phu D. Nguyen, San Jose; Ashok K. Mehan, Union City; Hans E. Lunk, Menlo Park; James M. O'Brien, Fremont, all of Calif.

[73] Assignee: Raychem Corporation, Menlo Park, Calif.

[21] Appl. No.: 847,558

[22] Filed: Mar. 6, 1992

[51] Int. Cl.[5] ..... H01B 7/08

[52] U.S. Cl. ..... 174/36; 156/55; 174/117 F

[58] Field of Search ..... 174/36, 117 F, 117 FF; 156/55; 385/114

[56] References Cited

U.S. PATENT DOCUMENTS

| | | | |
|---|---|---|---|
| 3,613,230 | 10/1971 | Griff | 174/36 X |
| 4,000,348 | 12/1976 | Harlow | 428/422 |
| 4,045,750 | 8/1977 | Marshall | 174/117 FF X |
| 4,113,335 | 9/1978 | Lang et al. | 174/72 A |
| 4,157,452 | 6/1979 | Pignataro et al. | 174/36 |
| 4,165,559 | 8/1979 | Lang et al. | 29/629 |
| 4,183,010 | 1/1980 | Miller | 367/154 |
| 4,478,778 | 10/1984 | Look | 264/146 |
| 4,501,929 | 2/1985 | Escallier et al. | 174/117 F |
| 4,538,024 | 8/1985 | Wise et al. | 174/117 F |
| 4,548,661 | 10/1985 | Escallier et al. | 156/52 |
| 4,616,717 | 10/1986 | Luetzow | 174/117 F |
| 4,625,074 | 11/1986 | Cox | 174/117 F |
| 4,626,298 | 12/1986 | Allard | 174/117 F X |
| 4,678,709 | 7/1987 | Tondre et al. | 428/380 |
| 4,678,864 | 7/1987 | Cox | 174/36 |
| 4,711,811 | 12/1987 | Randa | 428/383 |
| 4,767,891 | 8/1988 | Biegon et al. | 174/34 |
| 4,783,578 | 11/1988 | Bodensiek et al. | 174/117 F |
| 4,926,007 | 5/1990 | Aufderheide et al. | 174/36 |
| 5,030,794 | 7/1991 | Schell et al. | 174/36 |

FOREIGN PATENT DOCUMENTS

| | | | |
|---|---|---|---|
| 257855 | 2/1988 | European Pat. Off. | 174/36 |
| 2036798 | 12/1979 | France . | |
| 2058439 | 8/1981 | United Kingdom . | |

*Primary Examiner*—Morris H. Nimmo

*Attorney, Agent, or Firm*—Herbert G. Burkard; Sheri M. Novack

[57] ABSTRACT

This invention relates to flat cables comprising a plurality of insulated conductors bonded to a metallic substrate. The metallic substrate is provided with a layer of polymeric material capable of bonding to the insulation of the conductors. The layer of polymeric material is bonded to the metallic substrate with a peel strength of at least about 1 pound per linear inch (pli). The insulated conductors are bonded to the layer of polymeric material. The bond strength between the insulated conductors and the layer of polymeric material and the bond strength between the layer of polymeric material and the metallic substrate are such that the individual insulated conductors can be cleanly peeled away from the substrate.

10 Claims, 3 Drawing Sheets

FLAT CABLE

BACKGROUND OF THE INVENTION

This invention relates to flat cable and in particular flat cable comprising a plurality of insulated conductors bonded to a metallic substrate.

Flat cables are well known and take several forms. In one form of flat cable a plurality of conductors are placed parallel to one another and are laminated between a pair of films which surrounds each conductor thereby insulating each conductor from its neighbors as well as forming the flat cable construction. The insulation of each individual conductor cannot always be controlled as precisely and reproducibly as desired.

Another form of flat cable addresses this issue and preinsulated conductors are bonded to a carrier film. The film is generally of a polymeric material similar to that of the insulation and in order to achieve a bond between the insulated conductors and the film, the film must be heated to about its melting point. At this temperature it is difficult to maintain the dimensions of the film and this can lead to improper alignment of the wires. Further, it has been found that with certain polymeric materials, for example polyvinylidene fluoride, the film becomes brittle when cooled following the bonding process. It is then difficult to separate an individual insulated conductor from the cable since the brittle film tends to break thereby destroying the cable. Also, the conductor generally then retains a strongly adherent residue of the brittle film. This tends to make it difficult to terminate the wire in a conventional connector. It is desirable to be able to peel the individual conductors from the film as cleanly as possible.

U.S. Pat. Nos. 4,625,074 to Cox, 4,767,891 to Biegon et al. and 4,678,864 to Cox describe attempts to obtain a flat cable having dimensional stability at elevated temperatures during the manufacture of the cable. These patents disclose the use of a carrier film comprising a laminate of an attachment layer of a first polymeric material and a dimensional stabilization layer of a material having a higher melting point than the first polymeric material. The attachment layer and the dimensional stabilization layer are joined together with an adhesive layer. In use, the flat cable can delaminate if the cable is subject to temperatures above the melting point of the adhesive layer.

U.S. Pat. No. 4,678,864 to Cox also discloses the use of a ground plane in the construction of a flat cable assembly. The ground plane is positioned between the flat cable and a plastic covering. The plastic covering is coated over a major portion of its surface with a release agent so that it can be readily separated from the cable. The ground plane itself is not bonded to the flat cable. The flat cable itself is of conventional structure comprising a supporting film and insulated wires and thus it would be difficult to peel individual insulated wires cleanly from the cable.

SUMMARY OF THE INVENTION

This invention provides a flat cable from which individual one or more of the individual conductors can be clearly peeled from the carrier film.

One aspect of this invention comprises a flat cable comprising:

(a) a plurality of elongated conductive components each individually surrounded with outer layer of a first polymeric material; and (b) a metallic substrate having on at least a portion of a surface thereof a layer of a second polymeric material capable of bonding to the first polymeric material, said layer being bonded to said surface with a bond strength of at least about 1 pound per linear inch (pli);

the conductors being arranged substantially parallel to each other and bonded to said layer of the second polymeric material.

Another aspect of this invention comprises a method of preparing a flat cable which comprises;

(a) arranging a plurality of elongated conductive components each individually surrounded by a layer of a first polymeric material, substantially parallel to one another;

(b) providing a metallic substrate having on at least a portion of a surface thereof a layer of a second polymeric material which is capable of bonding to the first polymeric material, said layer being bonded to said surface with a bond strength of at least about 1 pli;

(c) heating the conductors or the substrate or both to about the melting point of the second polymeric material;

(d) bringing the conductors in contact with the layer of second polymeric material;

(e) cooling the resulting assembly.

DETAILED DESCRIPTION OF THE INVENTION

Figure 1:
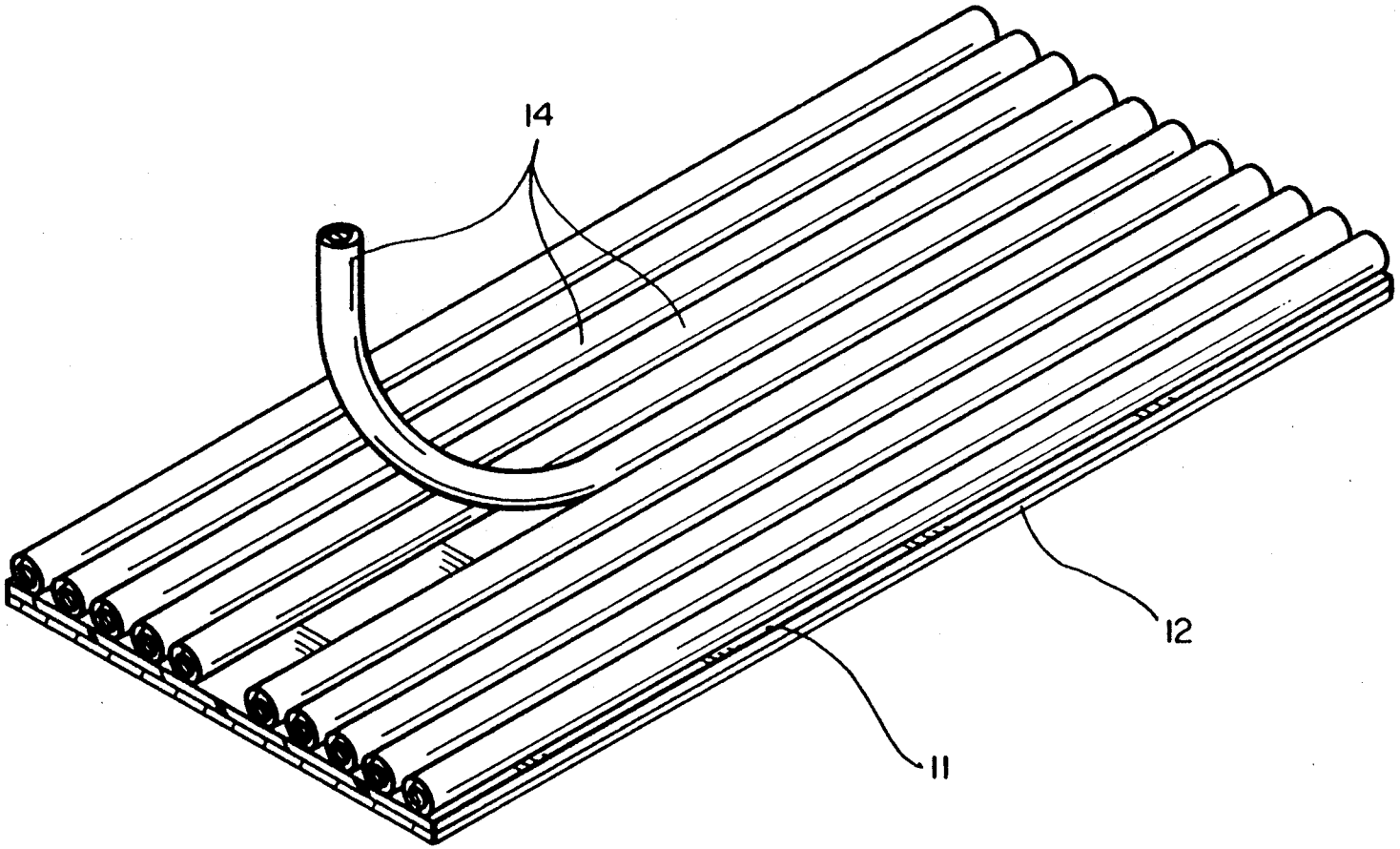
FIG. 1 illustrates a flat cable of this invention.

The flat cable of this invention comprises a plurality of conductors, each individually surrounded by a layer of a first polymeric material, bonded to a metallic substrate coated with a layer of a second polymeric material. FIG. 1 illustrates a flat cable of this invention in which each conductor comprises an insulated electrical conductor. In FIG. 1 a flat cable comprises a metallic substrate 12 having on a surface thereof a layer 11 of polymeric material (referred to herein as the second polymeric material) and individually insulated conductors 14.

The metallic substrate 12 is coated with a layer of polymeric material 11 which is capable of bonding to the insulation of conductors 14. The layer of polymeric material 11 is bonded to metallic substrate 12 with a bond strength of at least about 1 pli. Preferably the bond strength is about 1 to about 4 pli and most preferably between about 2 to about 3 pli.

The individual electrical conductors can be single or multiple stranded conductors. In other embodiments, one or more of the conductors comprises a twisted pair, i.e. a pair of individually insulated conductors twisted together, a cable, i.e. one or more insulated conductors within an outer jacket, including coaxial cables in which one of the conductors surrounds an inner insulated conductor.

In further embodiments of the invention, the conductor comprises an optical fiber surrounded with a layer of polymeric material (typically the jacket of a fiber optic cable). Thus, the term conductor is used herein to encompass a variety of possible arrangements of electrical conductors as well as optical fiber cables or individual optical fibers surrounded with a protective polymeric material. For the sake of convenience, the term insulated conductor is used herein to refer to any conductor or conductor arrangement surrounded by a layer of polymeric material.

The conductor is surrounded with a layer of a first polymeric material. The conductor can be surrounded by additional layers of polymeric material as long as the outer layer comprises the first polymeric material. The first polymeric material can be, for example, polyvinyl chloride, polyethylene, polyvinylidene fluoride, ethylene-tetrafluoroethylene copolymers (including terpolymers), ethylene-trichlorofluoroethylene copolymers, polyamides, in particular, aromatic polyamides, polyimides and the like. The polymeric material may be crosslinked if desired to provide improved properties, particularly at elevated temperatures.

In a preferred embodiment, the conductor is an electrical conductor insulated with a crosslinked ethylene-tetrafluoroethylene co- or terpolymer.

In accordance with this invention the insulated conductors are arranged parallel to one another and bonded to a metallic substrate coated on a surface thereof with a second polymeric material capable of bonding to the first polymeric material. The metallic substrate is preferably a metal foil, which is preferable nonporous. The metal is preferable copper, aluminum, or the like.

The metallic substrate is preferably about 10 to about 200 microns thick, move preferably about 20 to about 150 microns.

The metallic substrate is coated on a surface thereof with a layer of a second polymeric material. The layer of second polymeric material is preferably less than 5 mils thick, more preferably between about 0.25 mil and about 2 mils and most preferably between about 0.5 mil and about 2 mils. The second polymeric is capable of bonding to the first polymeric material which surrounds of the conductors to be formed into the flat cable. As shown in FIG. 1, one or more of the individual insulated conductors can be cleanly peeled from the cable. Peelability depends on the bond strength between the second polymeric layer and the metallic substrate, the bond strength between the second polymeric layer and the insulated conductors and the thickness of the second polymeric layer. It has been found that if the thickness of the second polymeric layer is greater than about 2 mils, it is difficult to cleanly peel the individual insulated conductors from the cable. Preferably the second polymeric material is of the same polymer as the outer layer. Preferred second polymeric materials are, for example, polyvinyl chloride, polyethylene, polyethylene terephthalate, vinylidene fluoride homopolymers and copolymers, ethylene-tetrafluoroethylene copolymers (including terpolymers), ethylene-trichlorofluoroethylene copolymers, tetrafluoroethyleneperfluoroalkoxy vinyl ether copolymers, polyamides, in particular, aromatic polyamides, polyimides and the like. In a preferred embodiment the individual conductors are insulated with crosslinked ethylene-tetrafluoroethylene copolymer (or terpolymer) and the second polymeric layer is of an uncrosslinked ethylene-tetrafluoroethylene copolymer (or terpolymer).

The second polymeric material can be applied to the metallic substrate in any convenient manner. For example, the polymeric material in the form of a solution, slurry or emulsion can be coated onto the substrate. The polymeric composition may be applied by spraying, brushing, spreading the composition over the surface of the substrate by use of a doctor blade, running the substrate through a bath of the polymeric composition or solution, slurry or emulsion of the polymeric composition. In another embodiment of the invention, the substrate is laminated to a pre-formed film of the second polymeric material.

An adhesive may be used to bond the layer of the second polymeric material to the metallic substrate. The particular adhesive used depends on the materials of the second polymeric layer and the metallic substrate. In a preferred embodiment of the invention, a layer of ethylene-tetrafluoroethylene copolymer (or terpolymer) is bonded to a copper foil substrate using an epoxy adhesive.

The cable is assembled by arranging the conductors in the desired parallel relationship. Adjacent conductors can be touching each other or spaced apart from each other, as desired. The conductors are then placed into contact with the coated surface of the metallic substrate. The substrate and/or the conductors are heated to about the melting point of the second polymeric material just prior to bringing the conductors and substrate into contact. Sufficient pressure is applied to effect the bonding. The amount of pressure applied should be about 1 to about 40 psi, preferably about 5 to about 20 psi. The assembly is permitted to cool.

Figure 2:
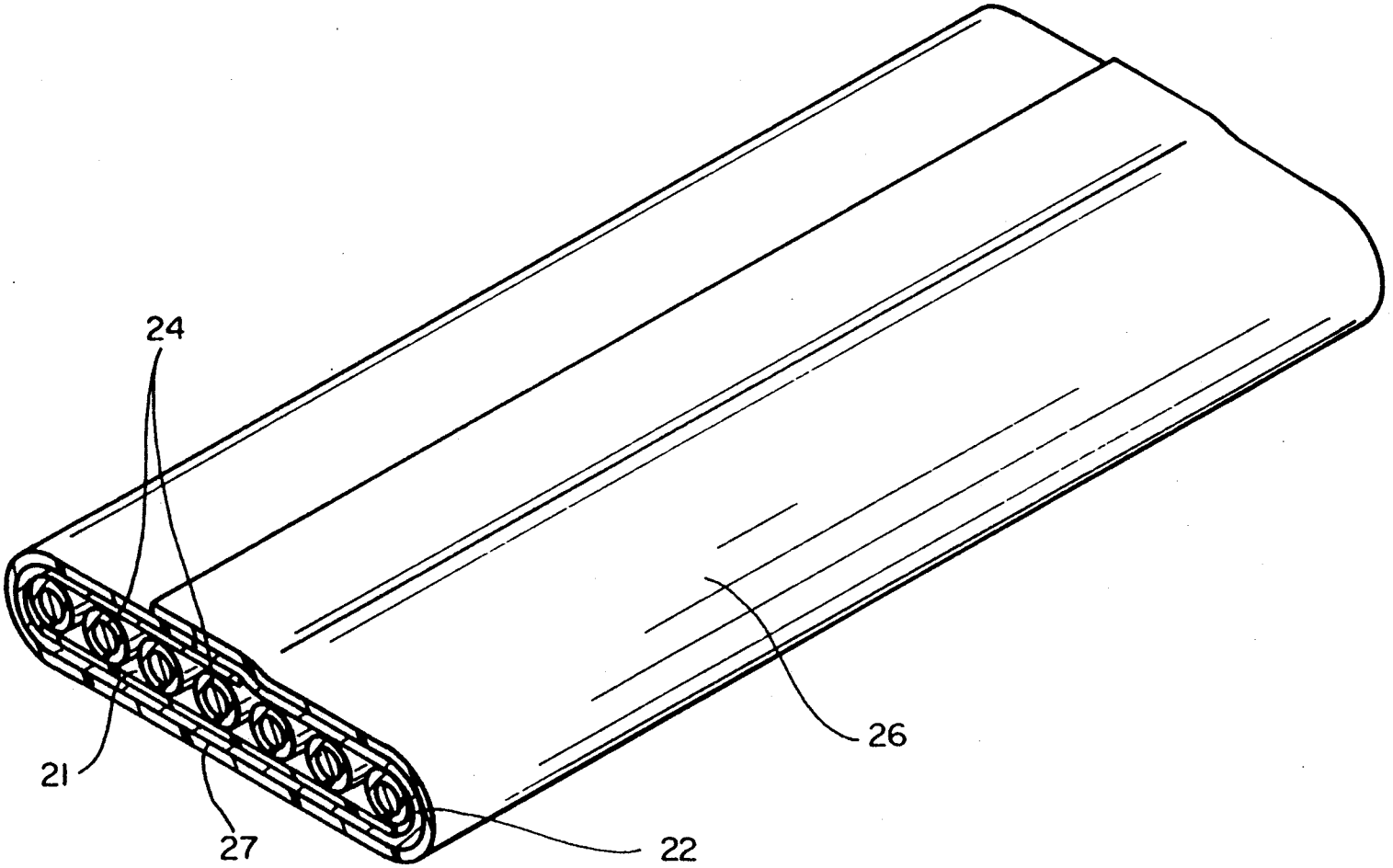
FIG. 2 illustrates a second embodiment of a flat cable of this invention.

As shown in FIG. 1, the metallic substrate 12 can be of approximately the same width as the set of wires (insulated conductors 14). In which case the metallic substrate acts as a ground plane. For certain applications it may be desirable to provide a shield around the wires as shown in FIG. 2. In FIG. 2, metallic substrate 22 encircles the insulated conductors 24 bonded to a central portion 27 of the metallic substrate 22 by a layer 21 of second polymeric material. The metallic substrate is provided with a layer of jacketing material 26, which may be the same or different than the polymer of the second polymeric layer. The extending portions of the metallic substrate are wrapped around the center portion to which the wires are bonded and the lateral edges are bonded together to form a complete enclosure.

The following examples illustrate the preparation of typical flat cable according to this invention.

EXAMPLE 1

Figure 3:
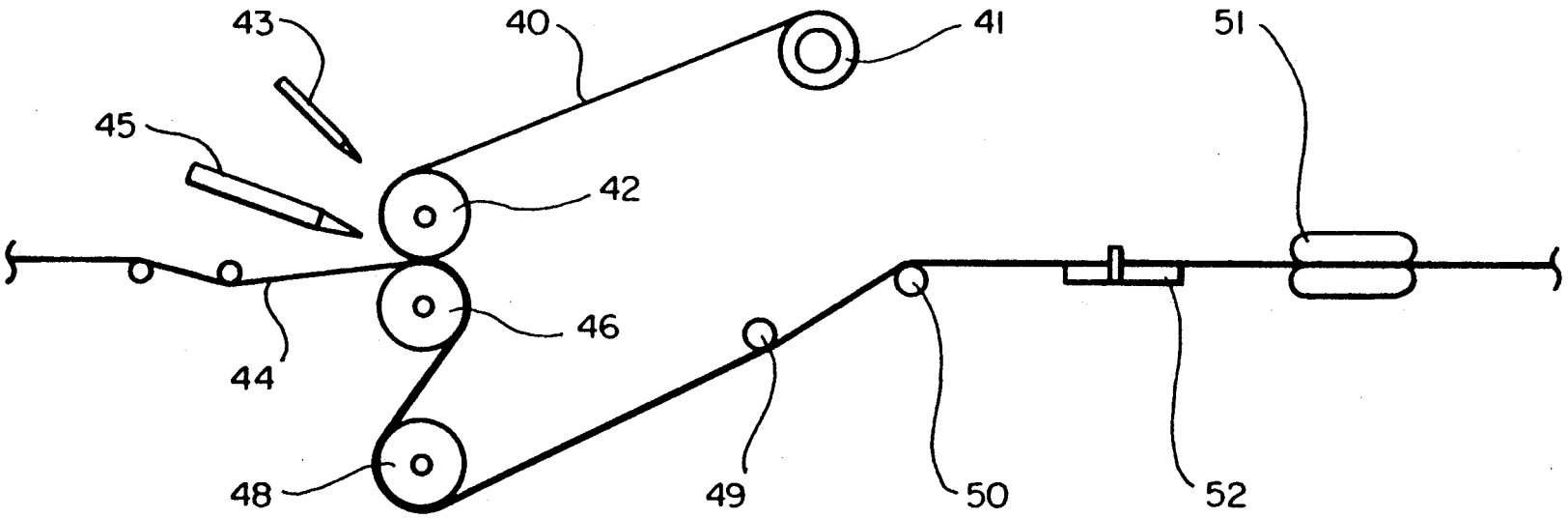
FIG. 3 illustrates a method for the manufacture of a flat cable of this invention.

The substrate for this flat cable is a composite which consists of a 1 oz. annealed copper foil and a 1 mil film of an ethylene-tetrafluoroethylene copolymer (Tefzel ® 280) bonded together by a 0.25 mil modified polyester epoxy adhesive. The substrate weighs 10 oz. per square yard with a total thickness of 2.5 mils. It is cut to a width of 3 inches before the following bonding procedure is carried out using the equipment shown in FIG. 3. The substrate 40 is paid off from a spool 41 and wound around roller 42 with the Tefzel ® side facing toward the hot air blowers 43 and 45 where it is heated to its melting point. The substrate is then brought in contact with 20 MIL-W-84585/5-24 primary wires arranged horizontally in a single layer 44. The bonding is achieved by passing the heated substrate and the wires between rollers 42 and 46 where Tefzel ® layer is fused to the wires under an applied pressure of approximately 20 psi. The laminate is then wound around roller 48, and through a set of wire guides 49 and 50 to the caterpillar take up 51. After the process the substrate has a tear strength of 6.5 lb when tested in accordance with ASTM-D-1004.

EXAMPLE 2

Example 1 is repeated using a composite substrate consists of 2 mils film of ethylene-tetrafluoroethylene copolymer (Tefzel® 280), 0.75 oz. annealed copper foil, and 0.5 mil Tefzel® 280 film. The layers are bonded together in the listed order by modified polyester epoxy adhesive. The substrate weighs 12 oz. per square yard with a total thickness of 3.5 mils. The substrate is then cut to a width of 5 inches. The bonding operation is carried out using the procedure and equipment as described in Example 1 with the 0.5 mil Tefzel® layer being fused to a 2 inch wide set of 20 MIL-W-84585/5-24 wires positioned in the center of the metallic substrate. The excess metal film substrate on both sides of the flat cable is folded by an in-line 360 degree wrapper (not shown, but which replaces slitter 52 of FIG. 3). The edges of the film substrate are then sealed together by a 2 mils thick polyester pressure sensitive adhesive tape. The finished flat cable has an integral shielding and a 2 mils ethylene-tetrafluoroethylene copolymer protective jacket.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

What is claimed is:

1. A flat cable comprising:

(a) a plurality of elongated conductive components each individually surrounded with an outer layer of a first polymeric material; and (b) a metallic substrate having on at least a portion of a surface thereof a layer of a second polymeric material capable of bonding to the first polymeric material, said layer of second polymeric material being bonded to said surface with a bond strength of at least about 1 pound per linear inch (pli);

the conductors being arranged substantially parallel to each other and bonded to said layer of the second polymeric material.

2. A cable in accordance with claim 1, wherein the substrate comprises a metal foil.

3. A cable in accordance with claim 1, wherein the substrate is about 10 to about 200 microns thick.

4. A cable in accordance with claim 1, wherein the metallic substrate comprises copper.

5. A flat cable comprising:

(a) a plurality of elongated conductive components each individually surrounded with an outer layer of a first polymeric material comprising cross-linked ethylene-tetrafluorethylene co- or terpolymer; and (b) a metallic substrate having on at least a portion of a surface thereof a layer of a second polymeric material capable of bonding to the first polymeric material, said layer of second polymeric material being bonded to said surface with a bond strength of at least about 1 pound per linear inch (pli);

the conductors being arranged substantially parallel to each other and bonded to said layer of the second polymeric material.

6. A cable in accordance with claim 5, wherein second polymeric material comprises an uncrosslinked ethylene-tetrafluoroethylene co- or terpolymer.

7. A cable in accordance with claim 1 wherein the metallic substrate encircles the wires bonded thereto to provide shielding.

8. A method of preparing a flat cable which comprises;

(a) arranging a plurality of elongated conductive components each individually surrounded by a layer of a first polymeric material, substantially parallel to one another;

(b) providing a metallic substrate having on at least a portion of a surface thereof a layer of a second polymeric material which is capable of bonding to the first polymeric material, said layer being bonded to said surface with a bond strength of at least about 1 pli;

(c) heating the conductors or the substrate or both to about the melting point of the second polymeric material;

(d) bringing the conductors in contact with the layer of second polymeric material;

(e) cooling the resulting assembly.

9. A flat cable comprising:

(a) a plurality of elongated conductive components each individually surrounded with an outer layer of a first polymeric material; and (b) a metallic substrate having on at least a portion of a surface thereof a layer of a second polymeric material capable of bonding to the first polymeric material, said layer of second polymeric material being bonded to said surface; and each of the conductors being arranged substantially parallel to each other and bonded to said layer of the second polymeric material such that each of the conductors are disposed adjacent said surface.

10. A flat cable comprising:

(a) a plurality of elongated conductive components each individually surrounded with an outer layer of a first polymeric material;

(b) a metallic substrate having on at least a portion of a surface thereof a layer of a second polymeric material capable of bonding to the first polymeric material, said layer of second polymeric material being bonded to said surface, the conductors being arranged substantially parallel to each other and bonded to the center portion of said layer of the second polymeric material;

(c) a layer of jacketing material extending around said metallic substrate and wrapped around the center portion to which the conductors are bonded, lateral edges of the layer of jacketing material being bonded together to form a complete enclosure.

* * * * *